United States Patent [19]

Uetsuji et al.

[11] Patent Number: 4,570,584

[45] Date of Patent: Feb. 18, 1986

[54] GENERAL-PURPOSE INTERNAL COMBUSTION ENGINE WITH VERTICAL CRANK SHAFT

[75] Inventors: Yonekazu Uetsuji, Saitama; Shoji Watanabe, Tokyo, both of Japan

[73] Assignee: Honda Giken Kogyo Kabushiki Kaisha, Tokyo, Japan

[21] Appl. No.: 542,629

[22] Filed: Oct. 17, 1983

[30] Foreign Application Priority Data

Oct. 15, 1982 [JP] Japan ..... 57-180867

[51] Int. Cl.[4] ..... F02N 17/00

[52] U.S. Cl. ..... 123/179 SE; 123/DIG. 7; 123/90.27; 123/195 HC; 123/196 W; 56/17.5

[58] Field of Search ..... 123/196 W, 195 HC, 196 R, 123/179 SE, DIG. 7, 90.27, 41.61; 184/6.5; 56/17.5, 255

[56] References Cited

U.S. PATENT DOCUMENTS

| | | | |
|---|---|---|---|
| 1,172,612 | 2/1916 | Kremer | 123/195 HC |
| 1,301,007 | 4/1919 | Roof | 123/DIG. 7 |
| 2,459,594 | 1/1949 | Smith | 123/196 W |
| 3,118,433 | 1/1964 | Lechtenberg | 123/41.31 |
| 3,195,526 | 7/1965 | Jordan | 184/6.5 |
| 4,372,258 | 2/1983 | Iwai | 123/196 W |
| 4,391,231 | 7/1983 | TateBe et al. | 123/41.69 |
| 4,401,067 | 8/1983 | Honda | 123/90.27 |
| 4,433,651 | 2/1984 | Nakakita et al. | 123/195 HC |
| 4,446,828 | 5/1984 | Bauder et al. | 123/195 HC |
| 4,452,194 | 6/1984 | Watanabe | 123/196 W |

FOREIGN PATENT DOCUMENTS

| | | | |
|---|---|---|---|
| 355365 | 8/1931 | United Kingdom | 123/DIG. 7 |
| 378216 | 8/1932 | United Kingdom | 123/DIG. 7 |

*Primary Examiner*—E. Rollins Cross

*Attorney, Agent, or Firm*—Armstrong, Nikaido, Marmelstein & Kubovcik

[57] ABSTRACT

A general-purpose internal combustion engine has a vertically extending crank shaft. The engine includes intake and exhaust valves disposed in overhead relationship to a cylinder head having an intake passage connected to the intake valve and an exhaust passage connected to the exhaust valve, the intake and exhaust passages being defined in opposite sides of the cylinder head. A carburetor and an air cleaner are coupled to the intake passage and located on the same side as the intake passage, and a muffler is connected to the exhaust passage and located on the same side as the exhaust passage. With this arangement, the engine has as small a height as possible.

6 Claims, 4 Drawing Figures

GENERAL-PURPOSE INTERNAL COMBUSTION ENGINE WITH VERTICAL CRANK SHAFT

BACKGROUND OF THE INVENTION

1. Field of the Invention

The present invention relates to a general-purpose internal combustion engine having a vertically extending crank shaft.

2. Description of the Prior Art

General-purpose internal combustion engines find use as the prime mover in various forms of agricultural and civil engineering equipment, and also in other devices such as lawn mowers. It is preferrable to reduce the height of the engine in order to lower the height of the entire device for stabilizing the same during operation.

Prior general-purpose internal combustion engines have intake and exhaust valves located side by side with intake and exhaust passages arranged in vertically juxtaposed relationship on one side of a cylinder head. A carburetor and an air cleaner which are connected to the intake passage and a muffler coupled to the exhaust passage have to be positioned so that they will not be disposed adjacent to each other on one side of the engine. This has imposed a limitation on the effort to reduce the height of the engine.

SUMMARY OF THE INVENTION

The present invention has been made in an effort to eliminate the difficulties with the conventional general-purpose internal combustion engines with vertical crank shafts.

According to the present invention, there is provided a general-purpose internal combustion engine having a vertical crank shaft, comprising a cylinder block including a cylinder barrel, a cylinder head, and a cylinder cover, intake and exhaust valves disposed in the cylinder head in overhead relationship thereto, an intake passage defined in a first side of the cylinder head, and openable and closable by the intake valve, an exhaust passage defined in a second side of the cylinder head which is opposite to the first side, and openable and closable by the exhaust valve, a carburetor and an air cleaner connected to the intake passage and located on one side of the cylinder block which is adjacent to the first side, and a muffler connected to the exhaust passage and located on an opposite side of the cylinder block which is adjacent to the second side.

Accordingly, it is an object of the present invention to provide a general-purpose internal combustion engine with a vertical crank shaft which has as low an overall height of the engine including a carburetor, an air cleaner, and a muffler as possible.

Another object of the present invention is to provide a general-purpose internal combustion engine with a vertical crank shaft which is constructed to prevent an intake passage and a carburetor from being adversely affected by the heat from an exhaust passage and a muffler.

Still another object of the present invention is to provide a general-purpose internal combustion engine with a vertical crank shaft which allows easy maintenance and servicing of a carburetor, an air cleaner, a fuel tank, and other components.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
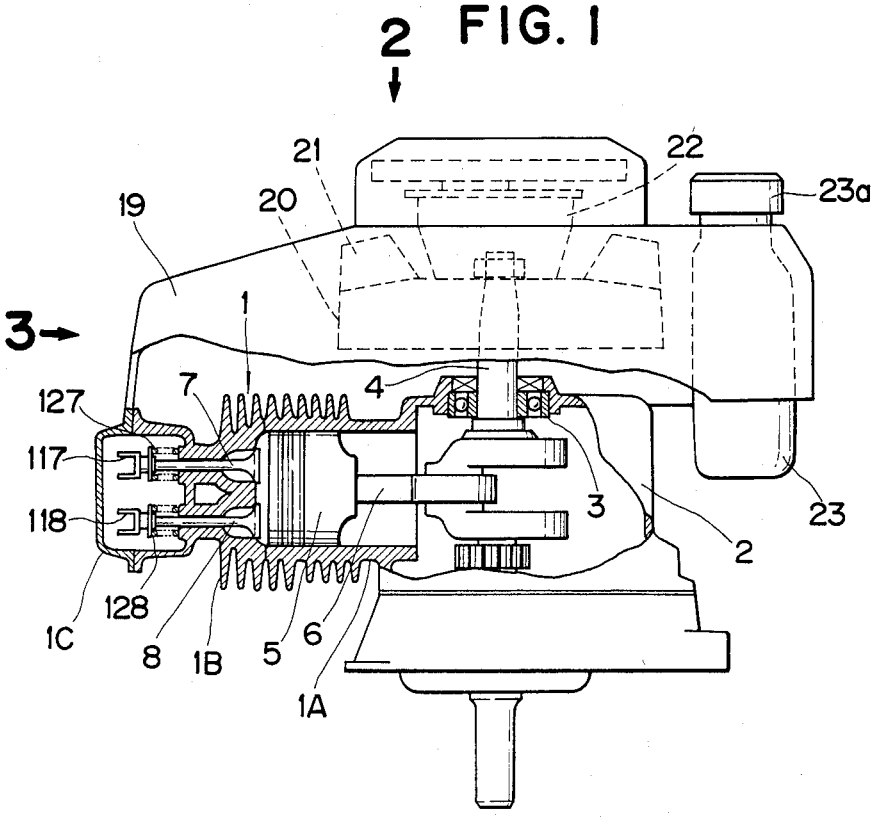
FIG. 1 is a side elevational view, partly in vertical cross section, of a general-purpose internal combustion engine having a vertical crank shaft according to the present invention.
Figure 3:
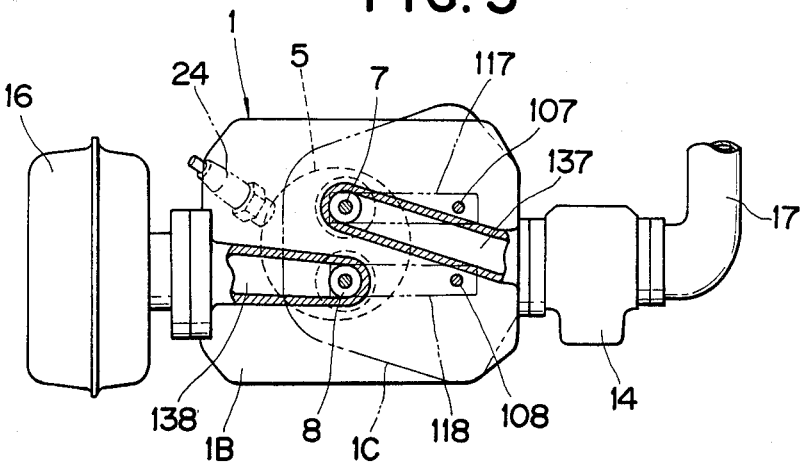
FIG. 3 is a front elevational view, partly in vertical cross section, as seen in the direction of the arrow 3 in FIG. 1.
Figure 2:
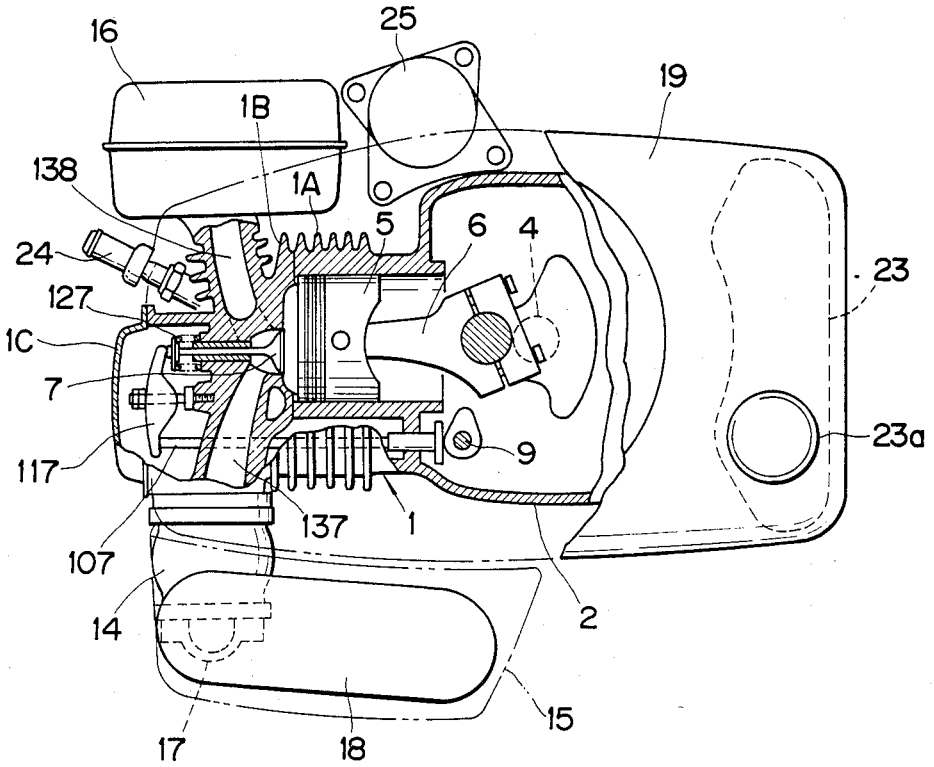
FIG. 2 is a plan view, with parts in horizontal cross section, as seen in the direction of the arrow 2 in FIG. 1.

As shown in FIGS. 1 through 3, a general-purpose internal combustion engine has a cylinder block 1 composed of a cylinder barrel 1A, a cylinder head 1B, and a head cover 1C with a cylinder axis extending horizontally. The internal combustion engine also includes a crank case 2 integral with the cylinder barrel 1A, a crank shaft 4 supported vertically by a bearing 3 centrally on the crank case 2, a piston 5 slidably disposed in the clinder barrel 1A, and a connecting rod 6 opertively interconnecting the crank shaft 4 and the piston 5.

An intake valve 7 and an exhaust valve 8 are mounted on the cylinder head 1B in an overhead-valve arrangement. The intake and exhaust valves 7, 8 are operatively connected to a valve driver mechanism comprising a cam shaft 9 (FIG. 2) rotatable about its own axis in synchronism with the crank shaft 4, a pair of push rods 107, 108 reciprocable rectilinearly by the cam shaft 9 as it rotates about its own axis, a pair of rocker arms 117, 118 angularly movable by the push rods 107, 108, respectively, and a pair of return springs 127, 128 acting on the intake and exhaust valves 7, 8, respectively, for normally urging them in a closing direction.

As illustrated in FIG. 3, the cylinder head 1B has an intake passage 137 extending from the intake valve 7 to the right (as shown) and an exhaust passage 138 extending from the exhaust valve 8 to the left (as shown), the intake and exhaust passages 137, 138 being openable and closable by the intake and exhaust valves 7, 8, respectively. Thus, the intake and exhaust valves 137, 138 are defined in the cylinder head 1B to cause an intake air-fuel mixture and an exhaust gas to flow in a crossing relation.

According to the embodiment shown in FIGS. 1 through 3, the intake valve 7 is disposed upwardly of a the exhaust valve 8. The intake passage 137 passes between the push rod 107 for the intake valve 107 and the push rod 108 for the exhaust valve 8 and is inclined upwardly toward the intake valve 7.

Figure 4:
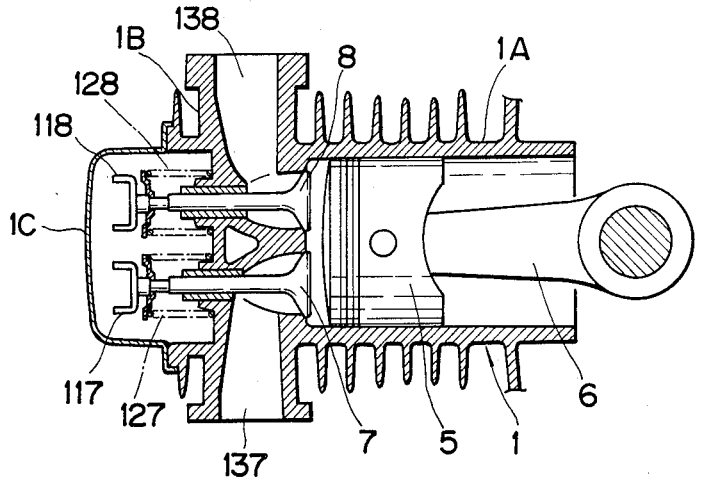
FIG. 4 is a horizontal cross-sectional view of a cylinder block of a general-purpose internal combustion engine having a vertical crank shaft according to another embodiment of the present invention.

FIG. 4 shows another embodiment in which intake and exhaust valves 7, 8 are disposed in horizontally juxtaposed relationship to each other. While the cam shaft 9 extends parallel to the crank shaft 4 in the embodiment of FIGS. 1 through 8, a cam shaft (not shown) in the embodiment of FIG. 4 extends perpendicularly across a crank shaft.

As illustrated in FIGS. 1 through 3, a carburetor 14 is joined to an outer opening of the intake passage 137, and an air cleaner 15 is connected to the carburetor 14. A muffler 16 is coupled to an outer opening of the exhaust passage 138. As shown in FIG. 2, the carburetor 14 and the air cleaner 15 is interconnected by an elbow 17. The air cleaner 15 has an air cleaner element 18 therein.

As shown in FIG. 1, an air guide cover 19 is disposed in overhanging and covering relationship to the cylinder block 1 and the crank case 2. A flywheel 20 and a fan 21 are mounted on the crank shaft 4 for corotation and positioned in the air guide cover 19. A recoil starter 22 and a fuel tank 23 with a fuel inlet 23*a* are supported in the air guide cover 19.

Briefly summarized, the general-purpose internal combustion engine having the vertically extending crank shaft 4 according to the present invention resides in that the intake and exhaust valves are disposed in an overhead arrangement, and the intake and exhaust passages 137, 138 extend in opposite sides of the cylinder head 1B, with the carburetor 14 and the air cleaner 15 being coupled to the intake passage 137 and the muffler 16 to the exhaust passage 138. The general-purpose internal combustion engine has the following advantages:

(1) Since the carburetor 14 and the air cleaner 15, and the muffler 16 are laterally spaced on opposite sides of the cylinder head 1B, the engine has a reduce height and a laterally balanced configuration, and is suited for use as a lawn mower prime mover. Where the engine is mounted on a lawn mower, it can effectively cut off the grass between bushes. With the intake valve 7 disposed above the exhaust valve 8 and the intake passage 137 inclined upwardly toward the intake valve 7 as shown in FIG. 3, the intake passage 137 has an outer opening located downwardly substantially at the same height as that of the outer opening of the exhaust passage 138. This permits the carburetor 14 and the air cleaner 15 to be lowered in position, contributing the reduced height of the engine.

(2) The intake passage 137 and the exhaust passage 138 are separated laterally from each other in the cylinder head 1B, and hence the carburetor 14 and the muffler 16 are spaced from each other. This configuration is advantageous in that the air-fuel mixture introduced through the intake passage 137 is not influenced by the heat of the exhaust gas discharged through the exhaust passage 138, and the cylinder head 1B can be cooled efficiently. The intake passage 137 inclined upwardly toward the intake valve 7 has a greater passage length for better fuel atomization therein then would a horizontal intake passage. There is a tendency of fuel to be trapped in the intake passage when blown back during engine operation and to flow into the combustion chamber when the engine is to be started again, resulting in an engine starting failure. Since the intake passage 137 is inclined upwardly toward the intake valve 7, any fuel trapped in the intake passage 137 will not be easily drawn into the combustion chamber. Such trapped fuel will be atomized as it flows along the wall of the relatively long intake passage 137 while being heated to an appropriate temperature therein. With the exhaust valve 8 located below the intake valve 7, any carbon deposited on the exhaust valve 8 or its valve seat is prevented from being peeled off into the intake valve 7 while the engine is in operation, and thus the intake valve 7 is protected from failiure to be seated on its valve seat due to unwanted carbon deposits.

(3) The carburetor 14, the air cleaner 15, a fuel cock, a governor control mechanism, and the fuel tank 23 which require frequence maintenance are located remotely from the muffler 16 which is heated to high temperatures, and can be serviced with ease. The muffler 16, a spark plug 24, and a starter motor 25 which are subjected to high temperatures and high voltages are spaced remotely from the fuel system composed of the carburetor 14, the fuel tank 23, and the fuel cock, an arrangement which is effective for fire prevention.

Although certain preferred embodiments have been shown and described, it should be understood that many changes and modifications may be made therein without departing from the scope of the appended claims.

What is claimed is:

1. A general-purpose internal combustion gasoline engine comprising:

(a) a cylinder block including a cylinder barrel, a cylinder head, and a cylinder cover;

(b) a crank shaft mounted in the cylinder block having an axis of rotation which extends vertically;

(c) intake and exhaust valves disposed in said cylinder head in overhead relationship and along a vertical plane including a longitudinal axis of said cylinder block;

(d) an intake passage defined entirely within a first side of said cylinder head, and openable and closable by said intake valve;

(e) an exhaust passage defined entirely within a second side of said cylinder head which is opposite to said first side, and openable and closable by said exhaust valve;

(f) a carburetor connected to said intake passage and located on the first side of said cylinder head; and (g) a muffler connected to said exhaust passage and located on the second side of said cylinder head.

2. A general-purpose internal combustion engine according to claim 1, wherein said intake valve is located upwardly of said exhaust valve.

3. A general-purpose internal combustion engine according to claim 2, including a valve drive mechanism composed of a cam shaft rotatable about its own axis in synchronism with rotation of said crank shaft and a pair of push rods reciprocably movable rectilinearly in response to rotation of said cam shaft, said pair of push rod being disposed vertically one above the other and extending substantially parallel to axes of said intake and exhaust valves, said intake passage extending between said push rods.

4. A general-purpose internal combustion engine according to claim 3, wherein said intake passage is inclined upwardly toward said intake valve.

5. A general-purpose internal combustion engine according to claim 4, wherein said intake and exhaust valves are operated by pushrods and rocker arms, and said intake passage passes between said pushrods.

6. A general-purpose internal combustion engine according to claim 5, wherein said intake valve is located above said exhaust valve, and the bottom of said intake passage, at the surface of said cylinder head, is disposed below the top surface of said exhaust passage at the surface of said cylinder head.

* * * * *

REEXAMINATION CERTIFICATE (834th)

United States Patent [19]

[11] B1 4,570,584

Uetsuji et al.

[45] Certificate Issued Mar. 29, 1988

[54] GENERAL-PURPOSE INTERNAL COMBUSTION ENGINE WITH VERTICAL CRANK SHAFT

[75] Inventors: Yonekazu Uetsuji, Saitama; Shoji Watanabe, Tokyo, both of Japan

[73] Assignee: Honda Giken Kogyo Kabushiki Kaisha, Tokyo, Japan

Reexamination Request:
No. 90/001,228, Apr. 24, 1987

Reexamination Certificate for:

| | |
|---|---|
| Patent No.: | **4,570,584** |
| Issued: | **Feb. 18, 1986** |
| Appl. No.: | **542,629** |
| Filed: | **Oct. 17, 1983** |

[30] Foreign Application Priority Data

Oct. 15, 1982 [JP] Japan ..... 57-180867

[51] Int. Cl.[4] ..... F02N 17/00

[52] U.S. Cl. ..... 123/179 SE; 123/DIG. 7; 123/90.27; 123/195 HC; 123/196 W; 56/17.5

[58] Field of Search ..... 123/196 W, DIG. 7, 179 SE, 123/90.27, 195 HC, 41.61; 184/6.5; 156/17.5, 255

[56] References Cited

U.S. PATENT DOCUMENTS

| | | | |
|---|---|---|---|
| 1,172,612 | 2/1916 | Kremer | 123/195 HC |
| 1,301,007 | 4/1919 | Roof | 123/DIG. 7 |
| 1,447,245 | 3/1923 | Gore | 123/195 A |
| 2,459,594 | 1/1949 | Smith | 123/196 W |
| 3,118,433 | 1/1964 | Lechtenberg | 123/41.31 |
| 3,195,526 | 7/1965 | Jordan | 184/6.5 |
| 3,323,504 | 6/1967 | Jacobi | 123/405 |
| 4,372,258 | 2/1983 | Iwai | 123/196 W |
| 4,391,231 | 7/1983 | Tatebe et al. | 123/41.69 |
| 4,401,067 | 8/1983 | Honda | 123/90.27 |
| 4,433,651 | 2/1984 | Nakakita et al. | 123/195 HC |
| 4,446,828 | 5/1984 | Bauder et al. | 123/195 HC |
| 4,452,194 | 6/1984 | Watanabe | 123/196 W |
| 4,513,702 | 9/1982 | Koga et al. | 123/193 H |

FOREIGN PATENT DOCUMENTS

| | | | |
|---|---|---|---|
| 959335 | of 1957 | Fed. Rep. of Germany . | |
| 1222317 | of 1966 | Fed. Rep. of Germany . | |
| 2624128 | of 1976 | Fed. Rep. of Germany . | |
| 2711681 | of 1978 | Fed. Rep. of Germany . | |
| 43205 | of 1979 | Japan . | |
| 129540 | of 1980 | Japan . | |
| 167543 | of 1980 | Japan . | |
| 13514 | of 1981 | Japan . | |
| 355365 | 8/1931 | United Kingdom | 123/DIG. 7 |
| 378216 | 8/1932 | United Kingdom | 123/DIG. 7 |
| 2069598 | of 1981 | United Kingdom . | |
| 2083863A | of 1982 | United Kingdom . | |

OTHER PUBLICATIONS

Japanese Periodical "Nainen Kikan", vol. 9, 9/10/70, Publisher San-Kai-Do.

"ZWEI Nue Porsche—Wagen Typ 901 und Gts 904".

"Die Ventilsteuerung Als Visitenkarte".

*Primary Examiner*—E. Rollins Cross

[57] ABSTRACT

A general-purpose internal combustion engine has a vertically extending crank shaft. The engine includes intake and exhaust valves disposed in overhead relationship to a cylinder head having an intake passage connected to the intake valve and an exhaust passage connected to the exhaust valve, the intake and exhaust passages being defined in opposite sides of the cylinder head. A carburetor and an air cleaner are coupled to the intake passage and located on the same side as the intake passage, and a muffler is connected to the exhaust passage and located on the same side as the exhaust passage. With this arrangement, the engine has as small a height as possible.

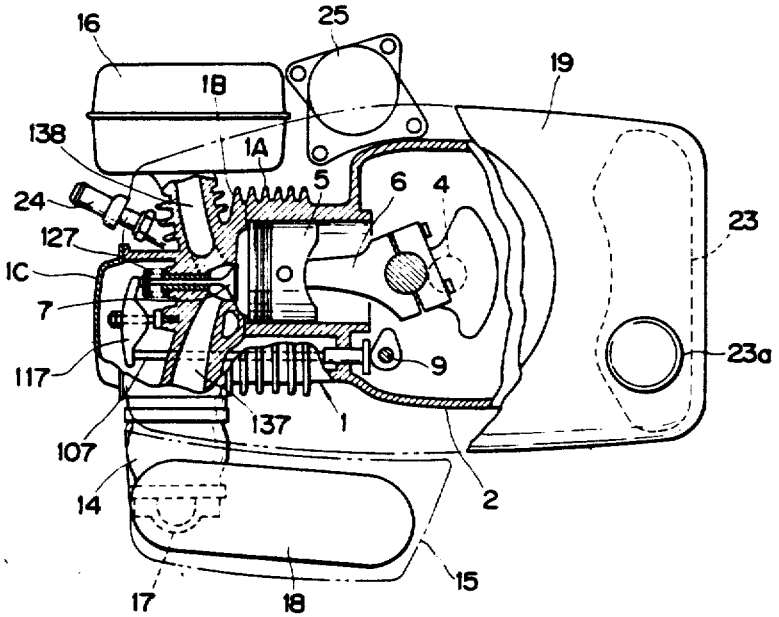

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–4 is confirmed.

Claim 5 is cancelled.

Claim 6 is determined to be patentable as amended.

New claims 7–16 are added and determined to be patentable.

6. A general-purpose internal combustion engine according to claim [5] *7*, wherein said intake valve is located above said exhaust valve, and the bottom of said intake passage, at the surface of said cylinder head, is disposed below the top surface of said exhaust passage at the surface of said cylinder head.

*7. A general-purpose internal combustion gasoline engine comprising:*

*(a) a cylinder block including a cylinder barrel, a cylinder head, and a cylinder cover;*

*(b) a crank shaft mounted in the cylinder block having an axis of rotation which extends vertically;*

*(c) intake and exhaust valves disposed in said cylinder head in overhead relationship and along a vertical plane including a longitudinal axis of said cylinder block, said intake valve being located upwardly of said exhaust valve;*

*(d) an intake passage defined entirely within a first side of said cylinder head, and openable and closable by said intake valve;*

*(e) an exhaust passage defined entirely within a second side of said cylinder head which is opposite to said first side, and openable and closable by said exhaust valve;*

*(f) a carburetor connected to said intake passage and located on the first side of said cylinder head;*

*(g) a muffler connected to said exhaust passage and located on the second side of said cylinder head;*

*(h) a valve drive mechanism composed of a cam shaft rotatable about its own axis in synchronism with rotation of said crank shaft; and*

*(i) a pair of push rods reciprocably movable rectilinearly in response to rotation of said cam shaft, said pair of push rods being disposed vertically one above the other and extending substantially parallel to axes of said intake and exhaust valves, said intake passage extending between said push rods, and being inclined upwardly toward said intake valve.*

*8. A general-purpose internal combustion engine according to claim 7, further comprising mounting portions on said cylinder head at the outer ends of said intake and exhaust passages, respectively, said mounting portions being mutually disposed at substantially the same level.*

*9. A general-purpose internal combustion engine according to claim 8 wherein said carburetor is directly coupled to said mounting portion at the outer end of said intake passage.*

*10. A general-purpose internal combustion engine according to claim 8 wherein said muffler is directly coupled to said mounting portion at the outer end of said exhaust passage.*

*11. A general-purpose internal combustion engine according to claim 6, further comprising mounting portions on said cylinder head at the outer ends of said intake and exhaust passages, respectively, said mounting portions being mutually disposed at substantially the same level.*

*12. A general-purpose internal combustion gasoline engine comprising:*

*(a) a cylinder block including a cylinder barrel, a cylinder head, and a cylinder cover;*

*(b) a crank shaft mounted in the cylinder block having an axis of rotation which extends vertically;*

*(c) intake and exhaust valves disposed in said cylinder head in overhead relationship and along a vertical plane including a longitudinal axis of said cylinder block, said intake valve being located upwardly of said exhaust valve;*

*(d) an intake passage defined entirely within a first side of said cylinder head, and openable and closable by said intake valve, said intake passage being inclined upwardly toward said intake valve;*

*(e) an exhaust passage defined entirely within a second side of said cylinder head which is opposite to said first side, and openable and closable by said exhaust valve;*

*(f) a carburetor connected to said intake passage and located on the first side of said cylinder head; and*

*(g) a muffler connected to said exhaust passage and located on the second side of said cylinder head.*

*13. A general-purpose internal combustion engine according to claim 12, wherein said intake and exhaust valves are operated by pushrods and rocker arms, and said intake passage passes between said pushrods.*

*14. A general-purpose internal combustion engine according to claim 13, further comprising mounting portions on said cylinder head at the outer ends of said intake and exhaust passages, respectively, said mounting portions being mutually disposed at substantially the same level.*

*15. A general-purpose internal combustion engine according to claim 14 wherein said carburetor is directly coupled to said mounting portion at the outer end of said intake passage.*

*16. A general-purpose internal combustion engine according to claim 14 wherein said muffler is directly coupled to said mounting portion at the outer end of said exhaust passage.*

* * * * *